US006992446B2

(12) United States Patent
Hashimoto et al.

(10) Patent No.: US 6,992,446 B2
(45) Date of Patent: Jan. 31, 2006

(54) HALOGEN LAMP WITH INFRARED REFLECTIVE COATING AND HALOGEN LAMP WITH REFLECTING MIRROR AND INFRARED REFLECTIVE COATING

(75) Inventors: Naotaka Hashimoto, Takatsuki (JP); Taku Ikeda, Katano (JP); Ichiro Shibagaki, Nishiwaki (JP); Ichiro Takeuchi, Akashi (JP)

(73) Assignees: Matsushita Electric Industrial Co., Ltd., Osaka (JP); Ushio Denki Kabushiki Kaisha, Tokyo (JP)

( * ) Notice: Subject to any disclaimer, the term of this patent is extended or adjusted under 35 U.S.C. 154(b) by 140 days.

(21) Appl. No.: 10/786,952

(22) Filed: Feb. 25, 2004

(65) Prior Publication Data

US 2004/0232836 A1 Nov. 25, 2004

(30) Foreign Application Priority Data

Feb. 25, 2003 (JP) ..... 2003-048076
Apr. 25, 2003 (JP) ..... 2003-122235

(51) Int. Cl.
*H01J 17/16* (2006.01)

(52) U.S. Cl. ..... 313/635; 313/634; 313/493

(58) Field of Classification Search ..... 313/634, 313/635, 493
See application file for complete search history.

(56) References Cited

U.S. PATENT DOCUMENTS 4,998,036 A * 3/1991 Matsuura et al. ..... 313/25
5,138,218 A * 8/1992 Honda et al. ..... 313/25
5,811,934 A 9/1998 Bunk et al.

FOREIGN PATENT DOCUMENTS

JP 10-501368 2/1998

* cited by examiner

*Primary Examiner*—Mariceli Santiago
*Assistant Examiner*—Anthony Perry

(57) ABSTRACT

A halogen lamp of a 12V type including: a glass part, a portion of which is a light emitting portion having a space therein and the rest of which is a sealing portion, both portions being made of quartz glass; an infrared reflective coating formed to cover an outer surface of the glass part; a filament which, supported by the sealing portion, is provided in the inner space of the light emitting portion; a molybdenum foil which is embedded in the sealing portion and is electrically connected to the filament; and a power supply line, one end of which is connected to the molybdenum foil, the other end exposed to outside. The halogen lamp satisfies 450 $mm^2 \leqq Sb \leqq 650$ $mm^2$ and $Se \geqq -0.35Sb+520$, where Sb and Se designate outer surface areas of the light emitting portion and the sealing portion, respectively.

9 Claims, 5 Drawing Sheets

HALOGEN LAMP WITH INFRARED REFLECTIVE COATING AND HALOGEN LAMP WITH REFLECTING MIRROR AND INFRARED REFLECTIVE COATING

BACKGROUND OF THE INVENTION (1) Field of the Invention

The present invention relates to a halogen lamp with an infrared rays reflective coating, and to a halogen lamp with a reflecting mirror and an infrared rays reflective coating.

(2) Description of the Related Art

With the recent trend toward energy saving, what is called a halogen lamp with an infrared reflective coating (hereinafter, the infrared reflective coating is referred to as an IR coating, and the halogen lamp with an infrared reflective coating is referred to as an IR-coated halogen lamp) has been developed and is becoming widespread. An IR-coated halogen lamp includes an arc tube that has a tungsten filament coil therein, with an infrared reflective coating formed on an outer surface of the arc tube.

As disclosed in Japanese Laid-Open Patent Application No. 10-501368, in the IR-coated halogen lamps, the IR coating formed on an outer surface of the arc tube receive infrared rays from the tungsten filament coil, and reflects them back to the tungsten filament coil. With this construction, the repeatedly reflected infrared rays heat the tungsten filament coil. This reduces the amount of power consumption in the IR-coated halogen lamps, thus improving the lamp efficiency.

The IR coating is basically composed of a plurality of layers including both high-refractive-index interference layers and low-refractive-index layers. With such a construction, on one hand, the IR coating reflects back the infrared rays to the tungsten filament coil, and on the other hand, the IR coating allows the visible rays to pass through itself to outside. Typically, tantalum oxide ($Ta_2O_5$) is used as the material of the high-refractive-index interference layers, and silica ($SiO_2$) is used as the material of the low-refractive-index interference layers, for the multi-layered IR coating for halogen lamps.

In recent years, two types of high-efficiency halogen lamps, which are manufactured using the CVD technology, have been on the market: a commercial voltage 100/110V type; and a low voltage 12V type.

In the above-mentioned high-efficiency halogen lamps, the arc tube, which is substantially spheroid and is made of quartz glass, has, on an outer surface thereof, the IR coating which is composed of approximately 20 $Ta_2O_5$—$SiO_2$ layers. The tungsten filament coil is deposited inside the arc tube on the central axis thereof. Also, a pair of lead wires are connected to the tungsten filament coil via molybdenum foils. The arc tube is hermetically sealed, and has a single-base structure. The lamp efficiency is as high as 22.4 lm/W and 25.4 lm/W in the cases of the 110V type and 12V type with 50 W, respectively.

It should be noted here that the term "substantially" used in the present document indicates a range that includes a general transposition, deviation or the like.

In addition to the above-mentioned improvement in terms of the lamp efficiency, recently an improvement using an optical system for energy saving has been put into practical use. More specifically, a halogen lamp with a reflecting mirror, which is a combination of a halogen lamp and a reflecting mirror that converges light beams emitted from the tungsten filament coil onto an object, is widely used as a lighting at shops or the like. Also, an IR-coated halogen lamp with a reflecting mirror, which is a combination of an IR-coated halogen lamp and a reflecting mirror, has lately been developed and is becoming widespread.

Among many types of such reflecting-mirror-attached IR-coated halogen lamps, a 12V type emits light beams having a higher luminous intensity than the other commercial voltage types of the same lamp input, in spite of its smallness. Accordingly, the reflecting-mirror-attached IR-coated halogen lamp of 12V type is superior at energy saving to the other types, and is expected to be widespread as a lighting at shops or the like. Among small-scale reflecting-mirror-attached IR-coated halogen lamps of 12V type, main products are a 35 W type and a 50 W type, both with a 50 mm-diameter reflecting mirror.

Meanwhile, the above-mentioned reflecting-mirror-attached IR-coated halogen lamps of a 12V type are generally more expensive than the other types. As a result, the market is demanding a lamp having as long a life as is commensurate with the cost. To meet the demand, the development of a reflecting-mirror-attached IR-coated halogen lamp of a 12V type (with a 50 mm-diameter reflecting-mirror) having a rated life of 4,000 hours has been worked on.

The inventors of the present invention have closely studied the life of the reflecting-mirror-attached IR-coated halogen lamp of 12V type over a considerable period of time. It was found through the study that when the lamps are continuously lighted in a long-term aging test, a serious quality problem occurs after the lamps, especially those of 50W type, are continuously lighted for approximately 3,000 hours. More specifically, it was found that as the lamp is continuously lighted, the temperature of the arc tube rises and a crack is generated in a sealing portion of the arc tube in which the lead wires and the molybdenum foils are embedded. It was also found that in some cases, the arc tube is broken as the sealing portion cracks, and that in rare cases, a front glass attached to the reflecting mirror is also broken by the breakage of the arc tube. Another quality problem was also found. That is to say, after a similar time period has passed during the long-term aging test, the IR coating on an outer surface of the arc tube peels off, which causes the infrared beams from the tungsten filament coil to leak and reduces the amount of light beams emitted from the lamp.

The tungsten filament coil wears as the lamp is lighted, due to vaporization. The life of a halogen lamp ends when the tungsten filament coil is finally broken by the wear. Compared to this, the above-mentioned two quality problems are abnormal since they occur before a lamp life comes to a normal end. Especially, the former problem of the crack in the arc tube should be eliminated with certainty since it concerns the safety during operation of the lamp.

As described above, at present, a main technical challenge regarding a reflecting-mirror-attached IR-coated halogen lamp of 12V type (especially of a high-wattage 50W type with a 50 mm-diameter reflecting mirror) is to find means for preventing the arc tube breakage and IR coating peeling that occur before a lamp life comes to a normal end.

SUMMARY OF THE INVENTION

The first object of the present invention is therefore to provide a safe and long-life infrared-reflective-material coated halogen lamp of 12V type that prevents with reliability the arc tube breakage and peeling of the infrared reflective coating, while maintaining high lamp efficiency.

More specifically, the infrared-reflective-material coated halogen lamp of 12V type is aimed, in the high 50-wattage type, to have lamp efficiency of at least 25(lm/W) and rated life or no shorter than 4,000 hours.

The second object of the present invention is to provide a reflecting-mirror-attached, infrared-reflective-material coated halogen lamp having been improved in energy saving.

The above object is fulfilled by a halogen lamp of a 12V type, comprising: a glass part, a portion of which is a light emitting portion having a space therein and the rest of which is a sealing portion, both portions being made of quartz glass; an infrared reflective coating formed to cover an outer surface of the glass part; a filament which, supported by the sealing portion, is provided in the inner space of the light emitting portion; a molybdenum foil which is embedded in the sealing portion and is electrically connected to the filament; and a power supply line, one end of which is connected to the molybdenum foil, the other end being exposed to outside the glass part, wherein 450 $mm^2 \leqq Sb \leqq 650\ mm^2$ and $Se \geqq -0.35Sb+520\ mm^2$, in which Sb designates an outer surface area of the light emitting portion and Se designates an outer surface area of the sealing portion, are satisfied.

Firstly, the above-described definition of the outer surface areas of the light emitting portion and the sealing portion enables the temperature rising of molybdenum materials in the arc tube, which is caused as the lamp is lighted, to be reduced, prevents the molybdenum materials from being oxidized, thus reducing the expansion of the metal portions in volume. This reduces the stress applied to the sealing portion, thus preventing the arc tube from breaking.

Secondly, the above-described definition of the outer surface areas of the light emitting portion and the sealing portion prevents the light emitting portion from being excessively heated, suppressing the light emitting portion from expanding, thus preventing the infrared reflective coating from peeling from the surface of the light emitting portion.

As described above, with the above-described definition of the outer surface areas of the light emitting portion and the sealing portion, it is possible to achieve a safe and long-life infrared-reflective-material coated halogen lamp of 12V type that ends its life by a normal cause of the tungsten filament coil breakage and lives at least the rated life of 4,000 hours.

It should be noted here that the fact that the above-stated excellent advantageous effects of the present invention can be provided by the above-described definition of the outer surface areas of the light emitting portion and the sealing portion has been confirmed by the inventors of the present invention through experiments that will be explained later.

In the above-described halogen lamp, the light emitting portion of the glass part may be either substantially spheroid or substantially spherical.

Also, the above-described halogen lamp may have 45 to 80 wattage inclusive. It has been confirmed that halogen lamps in this range of wattage provides excellent advantageous effects unique to the present invention.

The second object of the present invention can be fulfilled by a halogen lamp with a reflecting mirror, comprising: the above-described halogen lamp; and a reflecting mirror which is attached to the halogen lamp so as to surround the halogen lamp.

The above-stated construction improves the lamp efficiency by an optical method using a reflecting mirror, further providing an advantageous effect in addition to the advantageous effect of the long life of lamp.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

Embodiment 1

The following describes the first embodiment of the present invention with reference to FIGS. 1A to 5.

1. Construction of Present Invention 1-1. Construction of Halogen Lamp

Figure 1A:
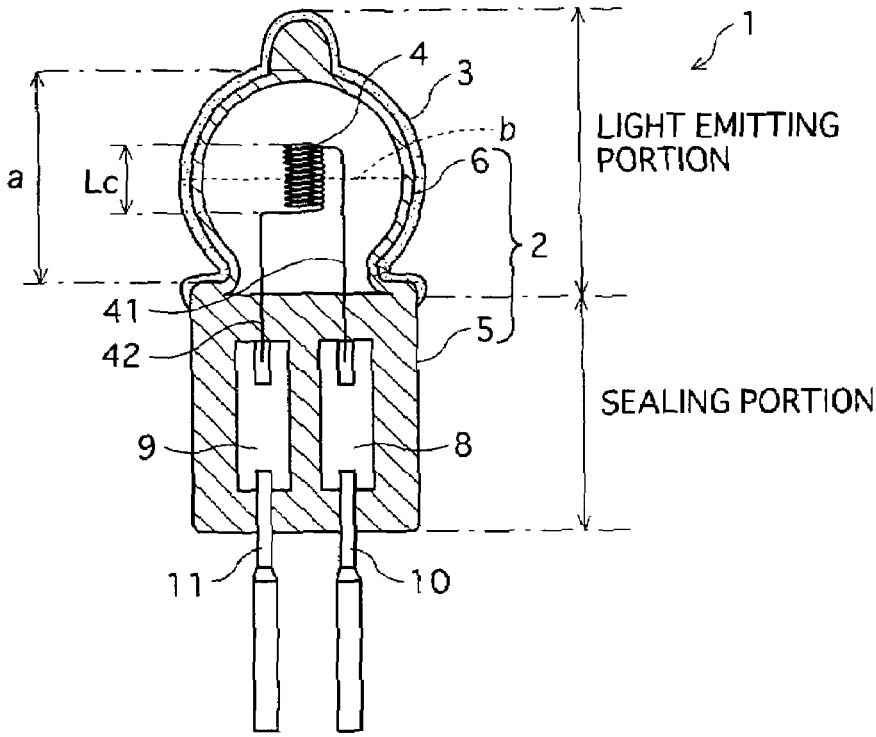
FIGS. 1A and 1B are sectional views of a halogen lamp 1 with an infrared reflective coating in Embodiment 1.
Figure 1B:
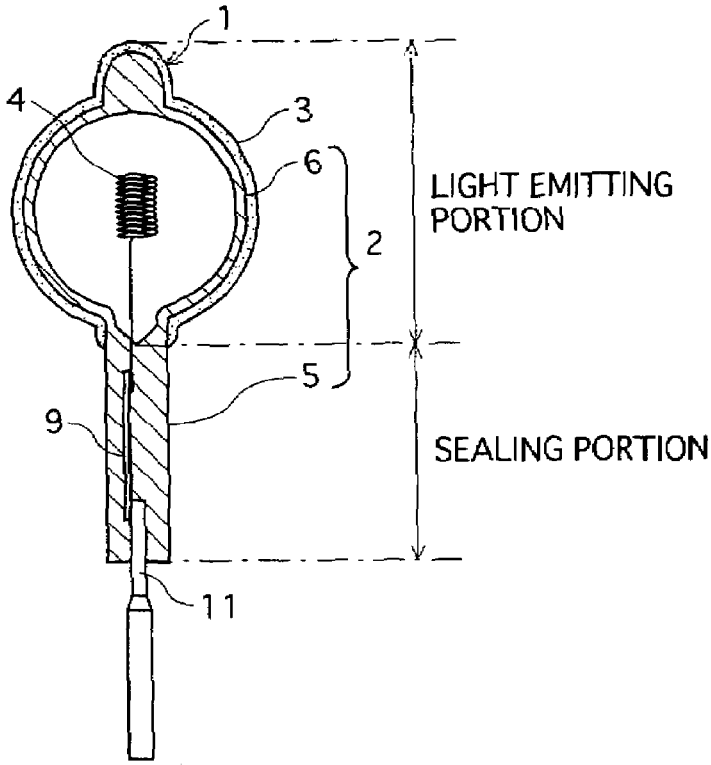

FIGS. 1A and 1B are sectional views of a halogen lamp 1 with an infrared reflective coating (IR-coated halogen lamp 1) of a 12V/50 W type in Embodiment 1, which is a low-voltage single-base halogen lamp (FIG. 1A is a front view; FIG. 1B is a side view).

As shown in FIGS. 1A and 1B, the IR-coated halogen lamp 1 includes, as a main component, an arc tube 2 made of quartz glass.

The arc tube 2 includes a light emitting portion 6 and a sealing portion 5. The light emitting portion 6 is substantially spheroid, is hollow inside, and has a long diameter "a" in a vertical direction of FIGS. 1A and 1B and a short diameter "b" in a horizontal direction of FIG. 1A. The sealing portion 5 is shaped in a rectangular solid, has wires 8 to 11 embedded therein, and is sealing the arc tube 2 at an end thereof. More specifically, in FIGS. 1A and 1B, the upper portion having a hollow of the arc tube 2 is regarded as the light emitting portion 6, and the lower portion being a solid object is regarded as the sealing portion 5.

In the present invention, an outer surface area Sb of a light emitting portion indicates an outer surface area of the entire light emitting portion 6 (including a projection at a tip thereof).

Also, in the present invention, an outer surface area Se of a sealing portion indicates an outer surface area of the entire sealing portion 5 (a sum of areas of the front and back main surfaces, the two side surfaces, and the bottom surface.

In the present invention, the values Sb and Se are set to predetermined ranges ($450\ mm^2 \leqq Sb \leqq 650\ mm^2$ and $Se \geqq -0.35Sb+520\ mm^2$). This suppresses the temperature increase at the surface of the light emitting portion 6 and in the sealing portion 5, preventing the arc tube breakage and peeling of the IR coating 3, thus providing a main effect of the present invention that the lamp can be lighted over a long time period in good condition. The effect of the lamp in regard with an extended life will be described later with reference to experimental data.

On an outer surface of the light emitting portion 6, the IR coating 3 composed of 18 $Ta_2O_5$—$SiO_2$ layers is formed using, for example, the CVD technology. The IR coating 3 may be made of other materials (for example, $TiO_2$ or $CeO_2$ as a high-refractive-index material, and $MgF_2$ as a low-refractive-index material). Also, the number of the layers is not limited to 18, but may be other numbers.

A tungsten filament coil 4 is, as a filament, deposited inside the light emitting portion 6 on the central axis thereof. The tungsten filament coil 4 is a single coil made of, for example, a tungsten line with a diameter of 190 $\mu$m. A length Lc and an outer diameter $\phi$c of the coil are set to, for example, 4.3 mm and 1.7 mm, respectively. Also, a ratio of the long diameter "a" to the short diameter "b" of the spheroid light emitting portion 6 (a/b) is set to, for example, "1.05" in correspondence with the measurement of the tungsten filament coil 4.

As shown in FIGS. 1A and 1B, lead wires 41 and 42, which are extensions of the tungsten filament coil 4, are respectively connected to rectangular metal foils, namely molybdenum foils 8 and 9, at ends thereof on the side of the light emitting portion 6. Also, as power supply lines, lead pins 10 and 11 made of molybdenum are respectively welded to the molybdenum foils 8 and 9, at the ends thereof opposite to the ends connecting the lead wires 41 and 42. The reason why molybdenum is selected is that it is the most appropriate metal material since it has an expansion rate close to that of quartz which is used as the material of the arc tube 2. Furthermore, the molybdenum foils are used to reduce the expansion of the metal portions in volume as much as possible.

To form the sealing portion 5 into a shape of a rectangular solid and seal the light emitting portion 6 by the sealing portion 5, the sealing portion 5 is pinched while it is heated with a gas burner while the sealing portion 5 holds the lead wires 41 and 42, molybdenum foils 8 and 9, and lead pins 10 and 11.

After the sealing portion 5 is formed as described above, the air is exhausted from the inner space of the arc tube 2 via an exhaust pipe (which is removed after the exhaust process, and is not illustrated), and then the inner space is filled with a filler gas. As the filler gas, for example, a xenon base gas containing 200 to 500 ppm of hydrogen bromide (HBr) is filled at a pressure of 0.6 Mpa.

The filler gas may contain xenon, krypton, argon, or nitrogen, or any combination of these gases. Also, it is preferable that the gas filling pressure is in a range from 0.1 to 1.0 MPa.

1-2. Construction of IR-Coated Halogen Lamp with Reflecting Mirror

Figure 2:
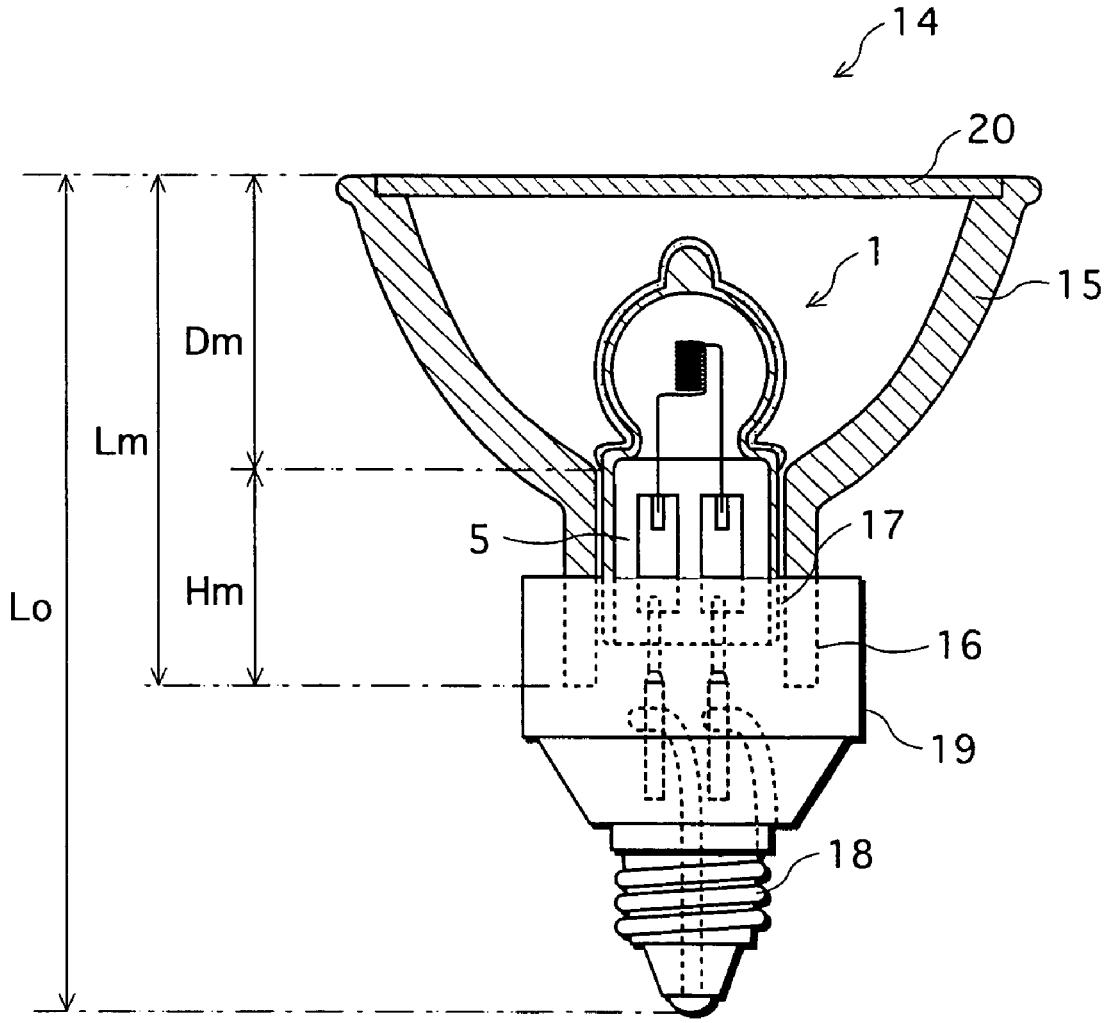
FIG. 2 is a sectional view of the IR-coated halogen lamp with a reflecting mirror in Embodiment 1.

FIG. 2 is a sectional view of the IR-coated halogen lamp 1 to which a reflecting mirror has been attached. As shown in FIG. 2, a reflecting-mirror-attached IR-coated halogen lamp 14 includes: the IR-coated halogen lamp 1; a reflecting mirror 15 that includes a rear attachment portion 16; a cement 17; a base 18; a ceramic holder 19; and a front glass 20. The sealing portion 5 of the IR-coated halogen lamp 1 is inserted into a space surrounded by the rear attachment portion 16 of the reflecting mirror 15, and both portions are inserted into the ceramic holder 19 and are fixed there by the cement 17 while the IR-coated halogen lamp 1 is electrically connected to the base 18.

The reflecting mirror 15 is of a typical type whose main body is made of hard glass. On an inner surface of the reflecting mirror 15, a visible light reflective coating, which is composed of a plurality of ZnS—$MgF_2$ layers, is formed. When the reflecting mirror 15 is combined with the IR-coated halogen lamp 1, the lamp efficiency and energy saving are further improved by the optical system.

The visible light reflective coating may be made of other materials such as an aluminum vapor deposition coating. The inner surface of the reflecting mirror 15 is formed to have appropriate beam angles that correspond to certain focusing levels of light beams that are emitted from the halogen lamp 1 and reflected on the inner surface of the reflecting mirror 15. The diameter $\phi$, depth Dm, and length Lm of the reflecting mirror 15 are, for example, 50 mm, 22 mm, and 37 mm, respectively. This measurement is a typical one. In this case, the height Hm of the rear attachment portion 16 of the reflecting mirror 15 is 15 mm. Here, the height Hm of the rear attachment portion 16 maybe 13 mm. The sectional measurement of the rear attachment portion 16 is also determined from the viewpoint of increasing the reflectance of the mirror. The long width and the short width of the rear attachment portion 16 are, for example, 14 mm and 7 mm, respectively.

The rear attachment portion 16 of the reflecting mirror 15 is inserted into the ceramic holder 19 and fixed by the cement 17. The base 18 of an EZ10 type is attached to the ceramic holder 19. The front glass 20 is attached to the front side of the reflecting mirror 15 for safety reasons. The length Lo of the reflecting-mirror-attached IR-coated halogen lamp 14 is, for example, 57.5 mm.

2. Advantageous Effects of Present Invention and Operating Temperature 2-1. Upper Limit of Temperature of Light Emitting Portion and Sealing Portion The inventors of the present invention conducted a long-term aging test on a halogen lamp of 12V/50W type to find means for preventing the arc tube breakage and IR coating peeling that occur before a lamp life comes to a normal end by breakage of the tungsten filament coil, before achieving the above described IR-coated halogen lamp 1 and the reflecting-mirror-attached IR-coated halogen lamp 14.

The goal of the long-term aging test was to prevent the above-described quality problems from occurring for at least 4,000 hours set as a rated life, and to hold, during the set rated life, the lamp efficiency at at least 25(lm/W), the highness of which is one of the characteristics of the halogen lamps.

The following describes some findings made in the aging test and other experiments conducted by the inventors of the present invention.

Firstly, it was found that the conventional breakage of the arc tube is caused by an oxidation with time of external lead pins made of molybdenum which are partially embedded in the sealing portion. It is considered that the oxidation causes the external lead pins to expand in volume, which generates a stress that makes the sealing portion crack, and that the crack triggers the breakage of the arc tube. It should be noted here that to prevent the materials made of molybdenum from being oxidized with the increase in the temperature of the sealing portion, it is defined in advance in the design of the halogen lamp that the temperature Ts of the sealing portion (the temperature in the vicinities of areas where the molybdenum foils and the external lead pins are welded) should not exceed 350° C. during the actual use of the lamp.

Secondly, in regards with the problem of IR coating peeling, it was found that especially in the IR coating composed of $Ta_2O_5$—$SiO_2$ layers, when the temperature Tb of the light emitting portion (the highest temperature measured on the outer surface of the light emitting portion 6 which is substantially spheroid, where it should be noted that the position having the highest temperature on the outer surface of the light emitting portion 6 changes in accordance with the direction in which the lamp emits light) exceeds 600° C. during the actual use of the lamp, the IR coating basically peels off due to a difference in thermal expansion between the IR coating and the quartz glass. It was found from this that to prevent the IR coating from peeling off, the temperature Tb of the light emitting portion should not exceed 600° C. It is therefore preferable that the lamp is defined so.

As apparent from the above disclosure, it was found that the above-described quality problems can be prevented from occurring if the temperature Tbi of the light emitting portion and the temperature Tsi of the sealing portion are respectively defined as being no higher than 600° C. and no higher than 350° C. This is because the thermal expansion of the arc tube is reduced and the oxidation of the materials made of molybdenum is suppressed by the above-mentioned definition.

2-2. Definition of Lamp Temperature in Actual Use

The inventors then analyzed as follows.

In the actual use, the reflecting-mirror-attached IR-coated halogen lamp is lighted while connected to or mounted in the ceramic holder, the base, the reflective mirror or the like, and generally is lighted while fixed to a lighting fitting such as a spotlight. As a result, factors to be considered in defining ranges of temperature Tbi of the light emitting portion and temperature Tsi of the sealing portion include a temperature rising caused by the lamp being surrounded by the ceramic holder, the base or the like, and a temperature rising caused by the lamp being fixed to a lighting fitting, as well as the temperature rising caused by the heating of the tungsten filament coil as it emits light.

To define appropriate ranges of temperature Tbi of the light emitting portion and temperature Tsi of the sealing portion, the inventors studied the conditions under which the temperature rising at the light emitting portion and the temperature rising at the sealing portion respectively become the largest when the lamp is fixed to a lighting fitting.

For this study, the lamp was lighted with 108% of the rated power based on section 5.2 of the JIS C 7527 standard. The temperature at the sealing portion was measured in accordance with the method defined in the JIS C 7802 standard. The test sample was a reflecting-mirror-attached IR-coated halogen lamp of 12V/50W type constructed approximately the same as the lamp shown in FIG. 2, and the measurement was made while the base of the lamp was attached to a socket that was provided at a closed back of a spotlight that had an opening of approximately 70 mm toward the front, the lamp being enclosed with the spotlight.

As a result of the study, it was found that when the halogen lamp was lighted with the lead pins oriented downward, temperature rising ΔTbi at the light emitting portion is 100° C. at the largest, and that when the halogen lamp was lighted with the lead pins oriented upward, temperature rising ΔTsi at the sealing portion is 90° C. at the largest.

It was found from the above-described data that temperatures Tbi,o and Tsi,o at the light emitting portion and the sealing portion when a bare lamp is lighted with a rated power of 50W are respectively defined as no higher than 500° C. and no higher than 260° C., temperatures Tbi and Tsi at the light emitting portion and the sealing portion when the lamp is lighted while fixed to a lighting fitting are respectively no higher than 600° C. and no higher than 350° C., which satisfies the conditions for preventing the above-mentioned quality problems.

2-3. Definition of Sb and Se in Present Invention

The inventors then studied the means for preventing the problems of arc tube breakage and IR coating peeling and achieving the lamp efficiency of at least 25 (lm/W) in the reflecting-mirror-attached IR-coated halogen lamp 1 of 12V/50W type in Embodiment 1 of the present invention.

Figure 3:
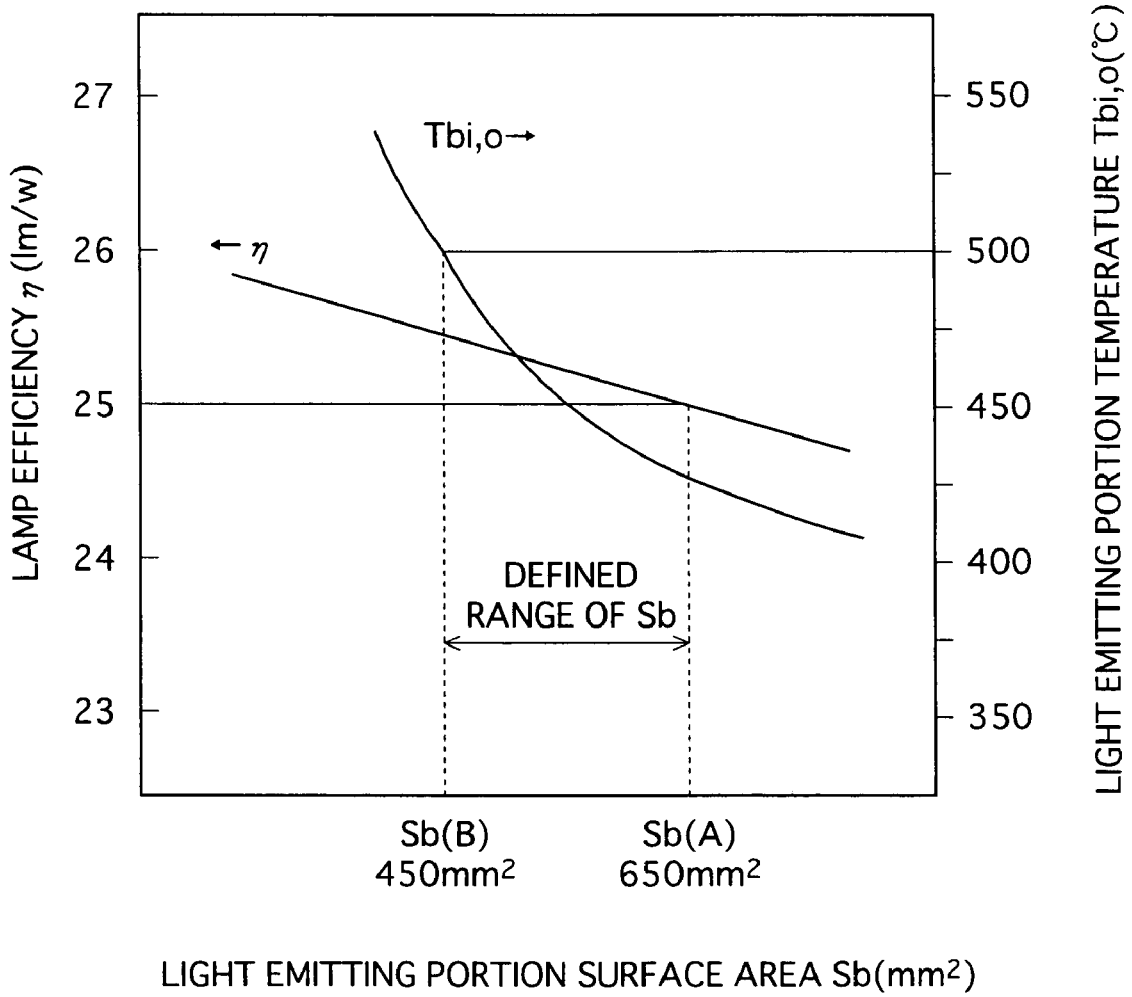
FIG. 3 shows a range of the outer surface area Sb of the light emitting portion that achieves the target lamp efficiency and prevention of the IR coating peeling.

The IR coating can be efficiently prevented from peeling if temperature Tbi,o at the light emitting portion is kept to be no higher than 500° C., as described above. FIG. 3 shows a range of the outer surface area Sb of the light emitting portion that achieves the target lamp efficiency and prevention of the IR coating peeling.

As shown in FIG. 3, temperature Tbi,o at the light emitting portion rises as outer surface area Sb of the light emitting portion decreases from (A) to (B). That is to say, the larger the outer surface area Sb of the light emitting portion 6 is, the lower the temperature is. According to the data shown in FIG. 3, temperature Tbi,o is kept to be no higher than 500° C. if outer surface area Sb of the light emitting portion 6 is set to no smaller than 450 $mm^2$.

On the other hand, the lamp efficiency of at least 25 (lm/W) can be achieved the following means. The lamp efficiency of an IR-coated halogen lamp is inversely proportional to the size, namely the outer surface area Sb of the light emitting portion 6 which is substantially spheroid. That is to say, the lamp efficiency increases as the outer surface area Sb decreases, as shown in FIG. 3. Basically, this is because as the outer surface area Sb decreases, the rate at which the infrared rays return to the tungsten filament coil by the IR coating increases. According to the data shown in FIG. 3, the target lamp efficiency of at least 25 (lm/W) can be achieved if the outer surface area Sb of the light emitting portion is set to no larger than 650 $mm^2$.

For the above-stated reasons, in the halogen lamp of the present invention, the outer surface area Sb of the light emitting portion is defined as being in a range from 450 $mm^2$ to 650 $mm^2$ inclusive to keep the target lamp efficiency of at least 25 (lm/W) and extend the lamp life by preventing the IR coating from peeling.

2-4. Preventing Arc Tube Breakage

Now, how to achieve the remaining goal of preventing the arc tube breakage for the halogen lamp of the present invention will be discussed. As described earlier, the arc tube breakage can be prevented if the temperature Tsi,o at the sealing portion is kept to be no higher than 260° C. Here, a further study by the inventors of the present invention revealed that the temperature Tsi,o at the sealing portion depends on two parameters: outer surface area Sb of the light emitting portion; and outer surface area Se of the sealing portion.

Figure 4:
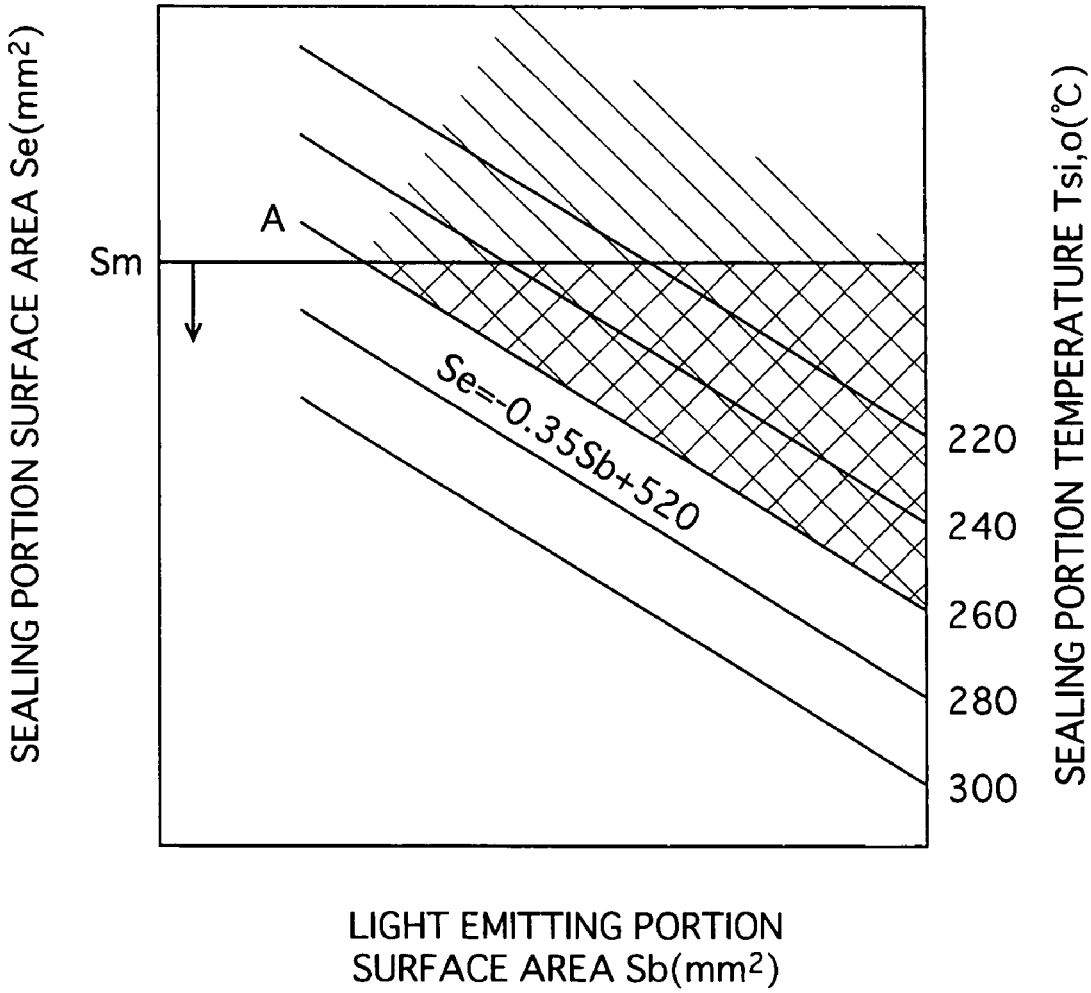
FIG. 4 shows the ranges of (i) outer surface area Sb of the light emitting portion and (ii) outer surface area Se of the sealing portion, required to achieve the goal of preventing the arc tube breakage.

FIG. 4 shows the ranges of (i) outer surface area Sb of the light emitting portion and (ii) outer surface area Se of the sealing portion, required to achieve the goal of preventing the arc tube breakage.

As shown in FIG. 4, the temperature Tsi,o at the sealing portion decreases as the outer surface area Se of the sealing portion increases. Also, the temperature Tsi,o at the sealing portion decreases as the outer surface area Sb of the light emitting portion increases (due to decrease in temperature Tbi, o at the light emitting portion). It is understood from the data shown in FIG. 4 that the temperature Tsi,o at the sealing portion is kept to be no higher than 260° C. if the outer surface areas Sb and Se are set to the range (the shaded areas in FIG. 4) on or above the isotherm A, which corresponds to 260° C. of the temperature Tsi,o at the sealing portion. Here, the isotherm A is represented by linear function Se=−0.35Sb+520. As a result, in the present invention, the outer surface areas Sb and Se are defined as $Se \geqq -0.35Sb+520\ mm^2$.

As described earlier, the sealing portion 5 is inserted into a space surrounded by the rear attachment portion 16 of the reflecting mirror 15, and both portions are inserted into the ceramic holder 19 and are fixed there by the cement 17, where the rear attachment portion 16 has a typical measurement. Accordingly, from the viewpoint of improving the attachment working efficiency, it is appropriate for the outer surface area Se to be defined as being smaller than inner surface area Sm of the rear attachment portion 16.

Figure 5:
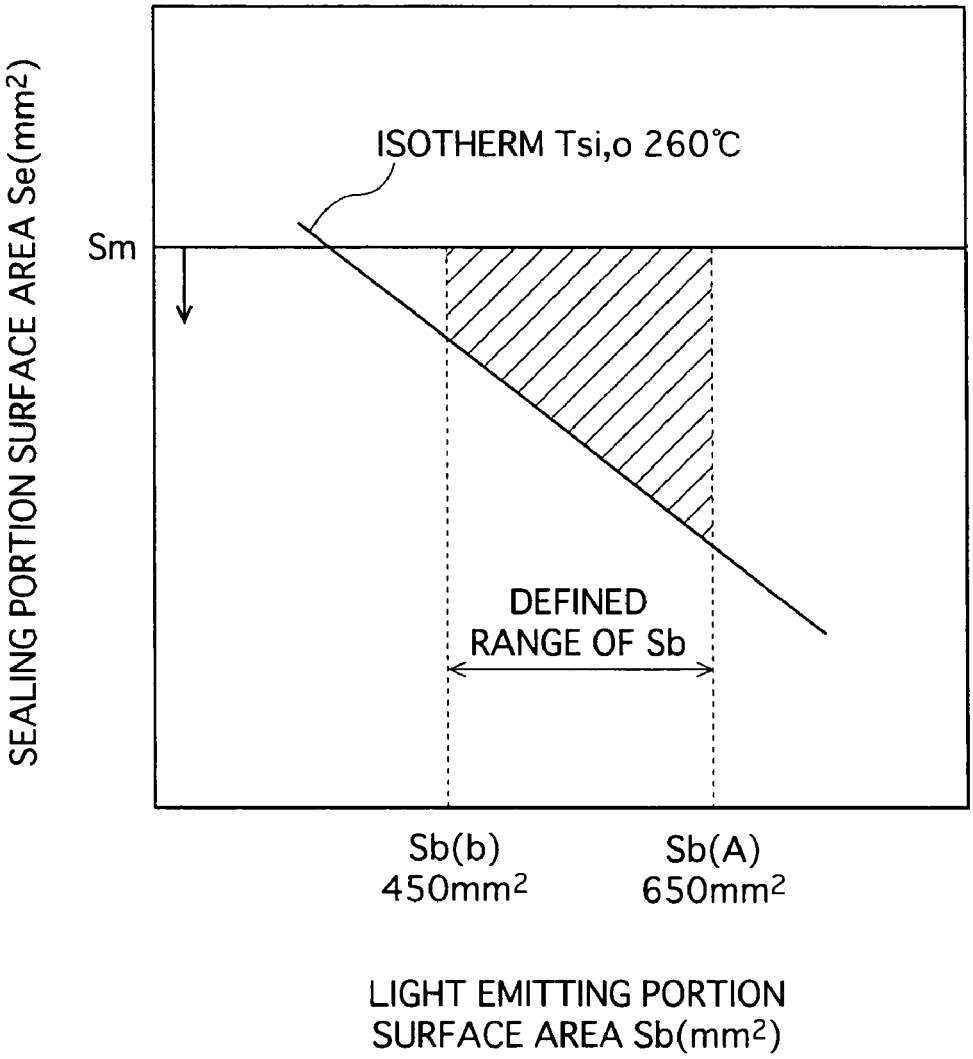
FIG. 5 shows a numerical range of the outer surface area Se of the sealing portion and the outer surface area Sb of the light emitting portion that should be defined to achieve all the goals of the present invention.

FIG. 5 shows a numerical range of the outer surface area Se of the sealing portion 5 and the outer surface area Sb of the light emitting portion 6 (the shaded area in FIG. 5) that should be defined to achieve all the goals of the present invention (preventing the problems of arc tube breakage and IR coating peeling and achieving the lamp efficiency of at least 25 (lm/W)), which is based on the combination of data shown in FIGS. 3 and 4.

FIG. 5 indicates that the outer surface area Se of the sealing portion 5 and the outer surface area Sb of the light emitting portion 6 should be defined as satisfying $450\ mm^2 \leqq Sb \leqq 650\ mm^2$ and $Se \geqq -0.35Sb+520\ mm^2$. It should be noted here that it is appropriate for the outer surface area Se to be defined as being smaller than inner surface area Sm of the rear attachment portion 16.

2-5. Effects Shown by Sample Lamps Satisfying Numerical Range

In accordance with the above-described data, reflecting-mirror-attached IR-coated halogen lamps 15 were manufactured as an example of Embodiment 1 of the present invention. The reflecting-mirror-attached IR-coated halogen lamps 15 each included the IR-coated halogen lamp 1 of 12V/50W type in which the outer surface area Se of the sealing portion 5 and the outer surface area Sb of the light emitting portion 6 were set to 390 $mm^2$ and 530 $mm^2$, respectively. Various lamp characteristics including the lamp life were measured on the sample lamps of the present embodiment.

In the reflecting-mirror-attached IR-coated halogen lamps 15, the long diameter "a" and short diameter "b" of the light emitting portion 6 which is substantially spheroid were set to 12.65 mm and 12 mm, respectively. Also, long width c, short width d, and height e of the sealing portion 5 were set to 11.1 mm, 3.0 mm, and 13 mm, respectively.

The measurement showed that the lamp efficiency of the sample lamps was 25.5 (lm/W) in average, achieving the goal, and that the central luminous intensity of the sample lamps was as high as 5,860 cd in average, where the sample lamps each had a reflecting mirror with 20 degrees of beam angle (shaped in a medium square).

In the long-term aging test, the problems of arc tube breakage and IR coating peeling did not occur to any sample lamps all through their lives which spanned 4,550 hours in average and ended by the normal breakage of the tungsten filament coil. The measurement results show that the present invention provides excellent advantageous effects.

As described above, it was found that in regards with the reflecting-mirror-attached IR-coated halogen lamps of 12V/50W type having a substantially spheroid arc tube (with 50 mm of mirror diameter) to which the present embodiment is applied, occurrence of arc tube breakage and IR coating peeling can be reduced with reliability through the entire life of at least 4,000 hours before the life ends with the normal breakage of the tungsten filament coil, holding the lamp efficiency at at least 25(lm/W), the highness of which is one of the characteristics of the halogen lamps.

In contrast, conventional lamps cannot obtain the advantageous effects of the present invention since they do not satisfy the range of the outer surface areas Sb and Se.

3. Others

In Embodiment 1, a reflecting mirror with mirror diameter of 50 mm is used. However, not limited to this, mirrors with different diameters may be used. Also, in Embodiment 1, a halogen lamp of a 50W type is used. However, it has been confirmed that the present invention can be applied to the halogen lamps with 45 to 80 wattage to gain excellent advantageous effects similar to those gained from the halogen lamps of 50-wattage type to which the present invention is applied.

The shape of the arc tube of the present invention is not limited to being substantially spheroid, but maybe substantially spherical or cylindrical to gain excellent advantageous effects similar to those gained from the substantially spheroid arc tube of the present embodiment. It should be noted here that the substantially spheroid arc tube can provide a merit of improving the lamp efficiency by enabling the infrared rays emitted from the tungsten filament coil to be efficiently recycled for the light emission.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A halogen lamp of a 12V type, comprising:

a glass part, a portion of which is a light emitting portion having a space therein and the rest of which is a sealing portion, both portions being made of quartz glass;

an infrared reflective coating formed to cover an outer surface of the glass part;

a filament which, supported by the sealing portion, is provided in the inner space of the light emitting portion;

a molybdenum foil which is embedded in the sealing portion and is electrically connected to the filament; and a power supply line, one end of which is connected to the molybdenum foil, the other end being exposed to outside the glass part, wherein $450\ mm^2 \leqq Sb \leqq 650\ mm^2$ and $Se \geqq -0.35Sb+520\ mm^2$, in which Sb designates an outer surface area of the light emitting portion and Se designates an outer surface area of the sealing portion, are satisfied.

2. The halogen lamp of claim 1, wherein the light emitting portion of the glass part is either substantially spheroid or substantially spherical.

3. The halogen lamp of claim 1 having 45 to 80 wattage inclusive.

4. A halogen lamp with a reflecting mirror, comprising:

the halogen lamp defined in claim 1; and a reflecting mirror which is attached to the halogen lamp so as to surround the halogen lamp.

5. A halogen lamp assembly comprising:

a quartz glass arc tube having an integral hollow light emitting portion and a solid sealing portion;

a multi-layer infrared reflective coating on the light emitting portion;

a light emitting filament supported by the sealing portion and positioned within the hollow of the light emitting portion, the sealing portion having power lines to enable a power source to activate the light emitting filament to provide light, wherein a relationship between an outer surface area, Sb, of the light emitting portion and Se, an outer surface area of the sealing portion fulfills the following conditions:

$$450\ mm^2 \leqq Sb \leqq 650\ mm^2$$

$$Se \geqq -0.35Sb+520\ mm^2$$

6. The halogen lamp assembly of claim 5 wherein the sealing portion has a thin rectangular box shape.

7. The halogen lamp assembly of claim 6 further including a glass reflecting mirror coated with a multi-layer reflective coating.

8. The halogen lamp assembly of claim 5 wherein the lamp assembly efficiency is at least 25 lm/w and has a life expectancy rating of at least 4000 hours.

9. The halogen lamp assembly of claim 5 wherein a range of power is 45 to 80 watts.

* * * * *